US012628957B2

(12) United States Patent
Mason et al.

(10) Patent No.: US 12,628,957 B2
(45) Date of Patent: May 19, 2026

(54) FLEXIBLE INTERNAL FRAME BACK REST WITH LOUNGE MAT

(71) Applicant: Dick's Sporting Goods, Inc., Coraopolis, PA (US)

(72) Inventors: Landon Mason, Coraopolis, PA (US); Craig Francis Hofmann, Pittsburgh, PA (US); Chinawut Paesang, Sewickley, PA (US)

(73) Assignee: DICK'S SPORTING GOODS, INC., Coraopolis, PA (US)

( * ) Notice: Subject to any disclaimer, the term of this patent is extended or adjusted under 35 U.S.C. 154(b) by 241 days.

(21) Appl. No.: 18/119,729

(22) Filed: Mar. 9, 2023

(65) Prior Publication Data

US 2023/0284783 A1 Sep. 14, 2023

Related U.S. Application Data

(60) Provisional application No. 63/269,240, filed on Mar. 11, 2022.

(51) Int. Cl.
*A47C 7/40* (2006.01)
*A47C 1/14* (2006.01)

(52) U.S. Cl.
CPC ..... *A47C 7/407* (2013.01); *A47C 1/146* (2013.01)

(58) Field of Classification Search
CPC ..... A47G 9/062; A47C 1/146; A47C 1/14; A47C 3/16; A47C 16/005; A47C 7/407; A47D 15/003; A47D 5/006
USPC ..... 5/417, 420, 656, 620
See application file for complete search history.

(56) References Cited

U.S. PATENT DOCUMENTS 1,640,743 A 8/1927 Yuhasz
2,857,957 A * 10/1958 Gay ..... A47C 4/52 248/156
3,018,132 A 1/1962 Baker et al.
3,404,915 A * 10/1968 De Souza Filho ..... A47C 4/52 5/418
3,669,489 A * 6/1972 Rock ..... A47C 1/146 248/432
4,194,601 A 3/1980 Yellin
(Continued)

FOREIGN PATENT DOCUMENTS

WO WO-2008119347 A1 * 10/2008 ..... A47C 27/086

OTHER PUBLICATIONS

Leinuosen Beach Lounge Chair, posted Jun. 1, 2023 [online], retrieved Aug. 7, 2023. https://www.amazon.com/dp/B0C6STB2M3/ (2023).

(Continued)

*Primary Examiner* — Justin C Mikowski
*Assistant Examiner* — George Samuel Gines
(74) *Attorney, Agent, or Firm* — Foley & Lardner LLP

(57) ABSTRACT

The present disclosure relates to a back support with a ground mat. The back support may include a backrest panel and a support panel having an internal frame member and a flexible support sheet. The backrest panel and support panel can be connected with a hinge. The back support may further include a ground mat portion having one or more ground mat panels. The back support may be configured to be placed in multiple positions, including a first position to support a user, a second position for transporting the back support, and a third flattened position.

20 Claims, 9 Drawing Sheets

(56) References Cited

U.S. PATENT DOCUMENTS

| | | | | |
|---|---|---|---|---|
| D274,493 | S | 7/1984 | Dyby | |
| 4,516,668 | A | 5/1985 | Grayek | |
| 4,553,785 | A | 11/1985 | Duke et al. | |
| 4,654,907 | A * | 4/1987 | Haugaard | A45C 3/10 5/420 |
| 4,687,248 | A | 8/1987 | Ross et al. | |
| 4,736,825 | A | 4/1988 | Belfi | |
| D299,988 | S | 2/1989 | Parabita | |
| 4,926,512 | A | 5/1990 | Coyle | |
| 4,942,948 | A | 7/1990 | Vickers | |
| 5,042,874 | A * | 8/1991 | Williams | A47C 4/52 297/377 |
| 5,110,219 | A | 5/1992 | Lopes | |
| 5,265,292 | A * | 11/1993 | Underell | A47C 4/52 5/419 |
| 5,384,923 | A | 1/1995 | Hwang et al. | |
| 5,425,567 | A | 6/1995 | Albecker | |
| 5,439,405 | A | 8/1995 | Storey et al. | |
| D374,789 | S | 10/1996 | Kalista et al. | |
| 5,640,727 | A | 6/1997 | Kappel | |
| 5,863,088 | A | 1/1999 | Kelly et al. | |
| D405,261 | S | 2/1999 | Lo | |
| 6,062,930 | A * | 5/2000 | Smith | A47C 15/006 441/125 |
| 6,168,612 | B1 | 1/2001 | Augustine et al. | |
| 6,240,712 | B1 | 6/2001 | Meijer | |
| D484,728 | S | 1/2004 | Ku | |
| D487,372 | S | 3/2004 | Ku | |
| D487,373 | S | 3/2004 | Ku | |
| 6,839,922 | B1 | 1/2005 | Foggett et al. | |
| D507,445 | S | 7/2005 | Song et al. | |
| D525,804 | S | 8/2006 | Schwartz | |
| 7,191,925 | B2 | 3/2007 | Aris et al. | |
| D548,479 | S | 8/2007 | Clark | |
| D587,507 | S | 3/2009 | Martin | |
| 7,621,005 | B1 | 11/2009 | Harvey | |
| 7,661,160 | B1 | 2/2010 | Adams | |
| D658,421 | S | 5/2012 | Williams | |
| 8,578,526 | B1 | 11/2013 | Rosso | |
| 9,095,234 | B2 | 8/2015 | Lee et al. | |
| 9,102,127 | B2 | 8/2015 | Berkowitz et al. | |
| 9,173,493 | B1 | 11/2015 | Fulton et al. | |
| 9,185,983 | B1 | 11/2015 | Cohen | |
| D762,399 | S | 8/2016 | Sorrick et al. | |
| 9,402,489 | B2 | 8/2016 | Clearman | |
| D776,459 | S | 1/2017 | Ibarra | |
| 9,808,087 | B1 * | 11/2017 | Ghazal | A47C 1/14 |
| 10,085,574 | B2 | 10/2018 | Kuhlmeier | |
| D835,432 | S | 12/2018 | Mcgregor | |
| 10,342,321 | B1 | 7/2019 | Le | |
| 10,463,178 | B2 | 11/2019 | Coffey | |
| D897,740 | S | 10/2020 | Tan | |
| D898,462 | S | 10/2020 | Tan | |
| D913,014 | S | 3/2021 | Gao | |
| D921,400 | S | 6/2021 | He | |
| D931,014 | S | 9/2021 | Shi | |
| 11,118,318 | B2 * | 9/2021 | Van Sant | A47C 27/14 |
| D937,012 | S | 11/2021 | Song | |
| D938,761 | S | 12/2021 | Zhou | |
| D938,762 | S | 12/2021 | Li | |
| D940,480 | S | 1/2022 | Dai | |
| D941,611 | S | 1/2022 | Zhang | |
| D942,185 | S | 2/2022 | Liang | |
| D942,186 | S | 2/2022 | Hu | |
| D942,778 | S | 2/2022 | Song | |
| D953,776 | S | 6/2022 | Meng | |
| D959,877 | S | 8/2022 | Meng | |
| D959,878 | S | 8/2022 | Meng | |
| D963,376 | S | 9/2022 | He | |
| D965,347 | S | 10/2022 | Tan | |
| D977,877 | S | 2/2023 | Chang | |
| 11,590,023 | B2 | 2/2023 | Mcgregor et al. | |
| 11,607,337 | B1 | 3/2023 | Elghobashi | |
| 11,730,289 | B2 | 8/2023 | Broesky | |
| D997,605 | S | 9/2023 | Zhao | |
| D1,031,321 | S | 6/2024 | Ni | |
| D1,033,992 | S | 7/2024 | Hu | |
| D1,033,993 | S | 7/2024 | Li | |
| D1,033,994 | S | 7/2024 | Li | |
| D1,033,995 | S | 7/2024 | Zhang | |
| D1,035,328 | S | 7/2024 | Li | |
| 12,042,425 | B2 | 7/2024 | Elghobashi | |
| D1,037,715 | S | 8/2024 | Zhao | |
| 2005/0125894 | A1 | 6/2005 | Bandak | |
| 2009/0322129 | A1 | 12/2009 | Rodill et al. | |
| 2010/0237667 | A1 | 9/2010 | Guy et al. | |
| 2014/0101848 | A1 | 4/2014 | Murphy | |
| 2015/0091336 | A1 * | 4/2015 | Loney | A47C 4/00 297/16.2 |
| 2015/0251046 | A1 * | 9/2015 | Liu | A47G 9/06 5/420 |
| 2016/0235225 | A1 * | 8/2016 | Lehovetzki | A47G 9/062 |
| 2018/0360240 | A1 | 12/2018 | Chiang | |
| 2019/0336328 | A1 | 11/2019 | Mcgregor et al. | |
| 2020/0022511 | A1 | 1/2020 | Gallegos | |
| 2020/0239114 | A1 | 7/2020 | De Grasse | |
| 2020/0375363 | A1 * | 12/2020 | Stinson | A47C 16/005 |
| 2023/0096465 | A1 | 3/2023 | Mcgregor | |

OTHER PUBLICATIONS

Beachcomber Portable Beach Chair & Tote, Picnic Time/Oniva, URL: https://www.picnictime.com/products/beachcomber-portable-beach-chair-and-tote [site visited Jul. 7, 2025].

HEX 2.0 PowerLounger, Crazy Creek, URL: https://crazycreek.com/products/hex-2-0-powerlounger?variant=44499740098876 [site visited Jul. 8, 2025].

Preferred Nation Beach Lounge Pad, Preferred Nation, URL: https://www.google.com/shopping/product/8710338395336613060?q=lay flat lounge mat&sxsrf=AOaemvleN37QtlChL2F0suUuGmleAGSiPg:1632250436753&biw=1920&bih=937&dpr=1&prds=eto:15727621256401455902_0&sa=X&ved=0ahUKEwiBv83m3pDzAhWCEIkFHUa7AcgQ8wlliAw [site visited Jul. 8, 2025].

ZNTS Beachcomber Portable Beach Chair u0026 Tote, ZNTS Wholesale, URL: https://doingjapan.com/products/znts-beachcomber-portable-beach-chair-u0026-tote-802-00-991-000-0?currency=USD&variant_sku_code=21419266-0-0-0-0-0&msclkid=d75284686744129d53e2ec0538b780c1 [site visited Jul. 8, 2025].

* cited by examiner

FLEXIBLE INTERNAL FRAME BACK REST WITH LOUNGE MAT

CROSS-REFERENCE TO RELATED PATENT APPLICATIONS

This application claims the benefit of and priority to U.S. Provisional Patent Application No. 63/269,240, filed Mar. 11, 2022, which is hereby incorporated by reference in its entirety.

FIELD

The present disclosure generally relates to a foldable ground mat with a back rest for supporting a user when seated on the ground.

BACKGROUND

Many beach-goers often desire to sit on the sand near the ocean and comfortably relax while enjoying the sun and waves. Some people will bring unwieldy foldable chairs to the beach side, but such chairs are often large, heavy, unwieldy, or lacking the ability recline. Others may bring a blanket to sit or lie on, but blankets do not offer any back support. Back support can be desirable to comfortable seating for extended periods of time, or while doing certain activities, such as reading or watching ocean waves. These desires and problems are faced not only by beach-goers, but also others seeking to enjoy the outdoors, for example, those who wish to have a picnic in a park.

Some conventional systems incorporate rigid backrests having heavy external frames. Although providing some back support, these can be uncomfortable and difficult to carry. Accordingly, a comfortable ground backrest solution can provide significant advantages and can also reduce or eliminate one or more of the foregoing challenges.

SUMMARY

The present disclosure relates generally to a foldable ground mat with a self-supported back rest portion. The back rest portion can include internal support members and can flex under the load of a user.

In one aspect, the disclosed technology relates to a collapsible back support including a backrest panel. The backrest panel can include a comprising: a first internal frame member, a first flexible support sheet, and a cover. The collapsible back support can further include a support panel having a second internal frame member, and a cover. In some embodiments, the backrest panel and support panel are hingedly connected along an edge of the backrest panel and an edge of the support panel. In some embodiments, the support panel further includes a second flexible support sheet. In some embodiments, the first flexible support sheet and second flexible support sheet are hingedly connected to form the hinge connection between the backrest panel and the support panel. In some embodiments, the hinge connection between the first flexible support sheet and second flexible support sheet comprises webbing attached to both the first flexible support sheet and the second flexible support sheet.

In some embodiments, the back support can be configured to have a first position and a second position; and the first position can support a user and the second position can be a collapsed position for transporting the back support. In some embodiments, the back support is configured to have a third position, the third position being an extended flattened position. In some embodiments, the backrest panel can be configured to deform under a weight of a user applied to the back support when in the first position. In some embodiments, the backrest panel is configured to form a curved surface along the hinge connection at the edge of the backrest panel and the edge of the support panel.

In some embodiments, the first and second internal frame members are configured to provide stiffness to the back support in a vertical direction and permit deformation in a horizontal direction. In some embodiments, the backrest panel further comprises a third internal frame member and the support panel further comprises a fourth internal frame member. In some embodiments, the back support can further include at least one ground mat panel. In some embodiments, the backrest panel further includes a cushion sheet. In some embodiments, the support panel further comprises a horizontal internal frame member. In some embodiments, the flexible support sheet comprises a polyethylene sheet.

In another aspect, the disclosed technology relates to a back support including: a backrest panel having a top edge and a bottom edge, a support panel having a top edge and a bottom edge, and a hinge connected to the top edge of the backrest panel and the top edge of the support panel. The hinge and top edges can be configured to deform under a load applied by a user resting against the back support. In some embodiments, the hinge and the backrest panel are configured to conform around the user's shoulders. In some embodiments, the deformation of the top edge of the backrest panel is greater than the deformation of the bottom edge of the backrest panel.

In some embodiments, a center point of the top edge of the backrest panel is displaced at least about one inch when the back support is a loaded in-use position as compared to an unloaded position. In some embodiments, the backrest panel further includes first and second internal support members, the support panel further includes third and fourth internal support members, and the first, second, third, and fourth internal support members are configured to bend under the load. In some embodiments, the first, second, third, and fourth internal support members are stiffer than the hinge and deform less than the hinge when the load is applied to the back support.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description.

DETAILED DESCRIPTION

Figure 1:
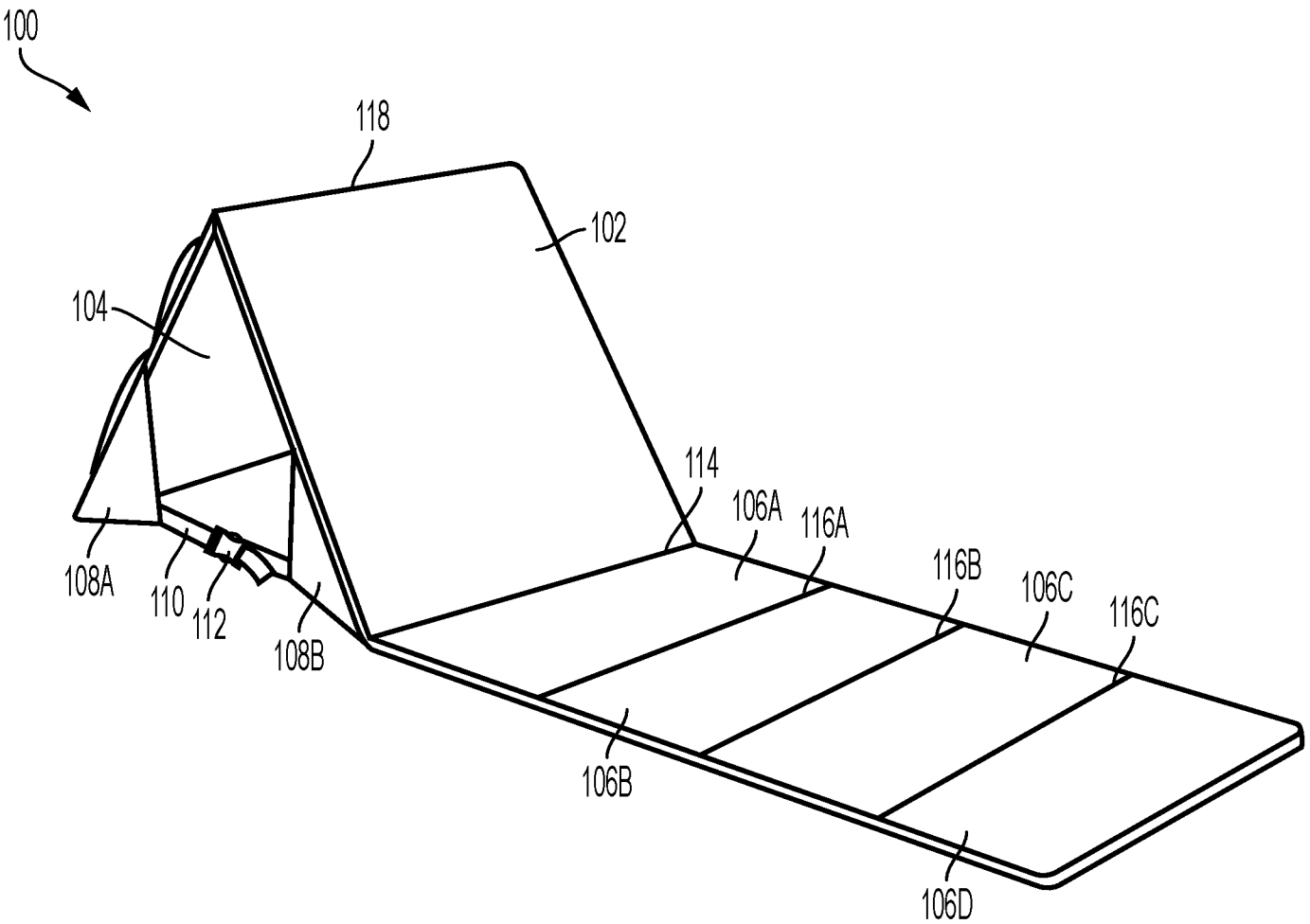
FIG. 1 is a perspective view of an exemplary flexible internal frame back support with lounge mat, consistent with disclosed embodiments.

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

The devices of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, proximal, distal, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

The present disclosure relates to a foldable back support with a lounge mat, the back support having a flexible internal frame. The internal frame can include multiple components of various stiffnesses. This combination can permit the back rest to flex and conform around the user, providing a comfortable lounging experience for the user. Additionally, the internal frame provides a sleek design that is lightweight and easy to transport. The lounger can be folded into a convenient size for carrying and may include pockets for storage or carrying of other items. The lounger may also include foam padding in the both the back rest and mat portions to further increase the comfortability of the lounger. Side support straps keep the lounger in an A-frame shape, but can be length adjustable to permit the user to customize the back rest angle.

Referring generally to FIGS. 1 to 4, various embodiments of the disclosure provide a back support 100. FIG. 1 is a perspective view of an exemplary back support 100 (also referred to herein as lounger 100, for simplicity and without being limited to single embodiment), consistent with disclosed embodiments. As shown in FIG. 1, the back support 100 can be positioned in a first position for supporting a user. Back support 100 can include a backrest panel 102 and support panel 104. Backrest panel 102 and support panel 104 can be connected (e.g., hingedly connected) along a top edge of each at a hinge 118. Hinge 118 can connect backrest panel 102 and support panel 104 together and can include an internal component, as described in greater detail below. Hinge 118 may take a variety of forms, as described herein. For example, hinge 118 may comprise one or more pieces of webbing, an integral plastic hinge, a non-integral plastic hinge, or the like.

Triangular gussets 108A-D can be attached to backrest panel 102 and support panel 104. Triangular gussets 108A-D can include straps 110A-D having a buckle 112A-D. When left and right side buckles 112A-D are connected, the strap 110 can be placed in tension between, for example, gussets 108A and 108B. This tension can keep the back support 100 in an A-frame shape. While straps 110A-D are depicted with buckles in the Figures, in some embodiments, the straps on each side of the A-frame of back support 100 may be a single piece and non-adjustable. In other embodiments, straps 110 may include a slider to adjust strap length in addition to, or in place of, a buckle. Further, straps 110 may include webbing, straps, cords, ropes, elastic, etc.

Gussets 108A-D can distribute the tension along a larger portion of the edges of backrest panel 102 and support panel 104 (e.g., from about twenty percent to about fifty percent of the length of the edge of backrest panel 102 or support panel 104). For example, as illustrated by FIG. 1, the gusset length along the edges of backrest panel 102 and support panel 104 may be about 45% of the length of the backrest panel 102 or support panel 104. In some embodiments, back support 100 is at least partially ornamental in nature and features non-functional elements.

Figure 5B:
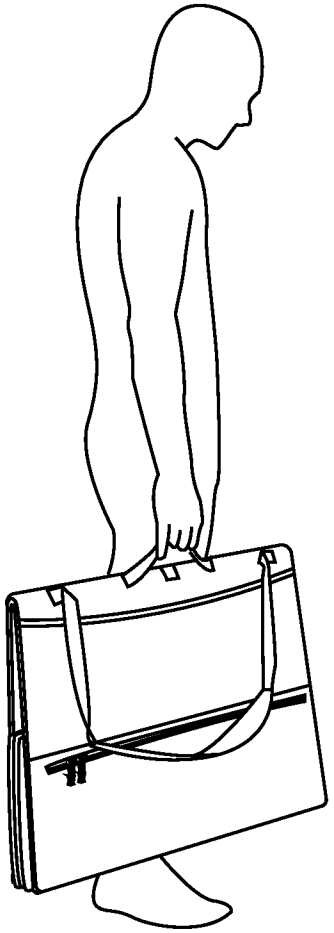
FIG. 5B is a back view of an exemplary flexible internal frame back support with lounge mat in a folded configuration, consistent with disclosed embodiments.
Figure 5A:
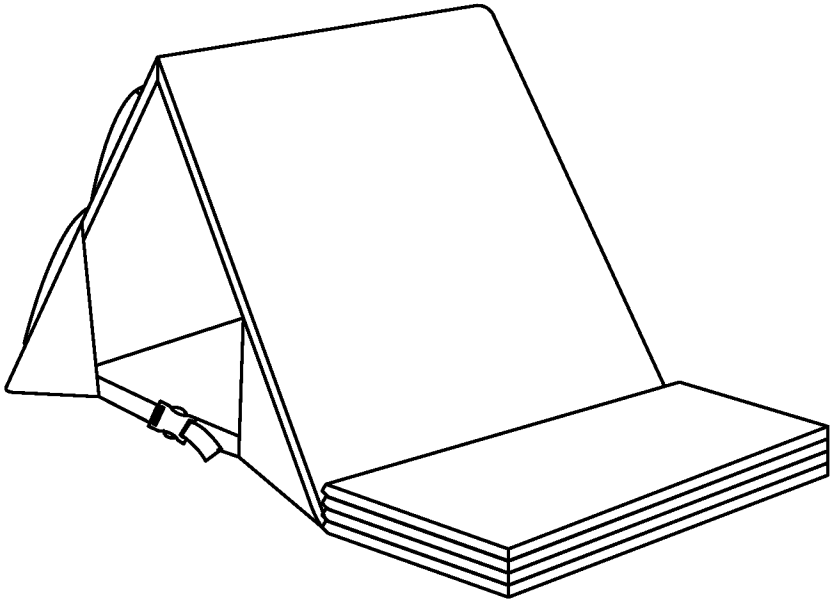
FIG. 5A is an illustration of an exemplary flexible internal frame back support with lounge mat in a folded seat configuration, consistent with disclosed embodiments.

Back support 100 can also include one or more ground mat panels 106A-D. While the Figures generally illustrate back support 100 as having four ground mat panels 106A-D, more or fewer ground mat panels are possible. For example, back support 100 could have one or two ground mat panels 106. Hinge 114 can be disposed between backrest panel 102 and first ground mat panel 106A. Hinge 114 can take a variety of forms, for example, a sewn portion of cover 602 (as described in greater detail below), a web strap sewn between backrest panel 102 and ground mat panel 106A, or other suitable flexible structure. Similar to hinge 114, hinges 116A-C may be present between ground mat panels 106A-D. Hinges 114 and 116A-D can permit folding of the ground mat panels such that they lay between backrest panel 102 and support panel 104. As another example, a user may also fold ground mat panels 106C and 106D such that they are underneath or on top of ground mat panels 106A and 106B, respectively. Thus, because ground mat panels 106A-D can be padded (as described in greater detail below, for example, with respect to FIG. 7) the user may experience a more comfortable seating arrangement with double padding (e.g., in situations where the full ground mat may not be needed). Similarly, a set four layers thick could be formed by folding ground mat panels 106B, 106C, and 106D underneath or on top of ground mat panel 106A. Such a folded arrangement with a four-layer seat is illustrated by FIG. 5A.

In some embodiments, ground mat panels 106A-D may be flexible enough to fold without the use of hinges between the panels. Ground mat panel's 106A-D may take the form of on solid flexible mat capable of being folded into one or more of the configurations described herein. In other embodiments, back support 100 can include 2 panels with one hinge in between, but the panels may be flexible and capable of being folded to, for example, reach the arrangement illustrated by FIG. 5A.

Figure 2:
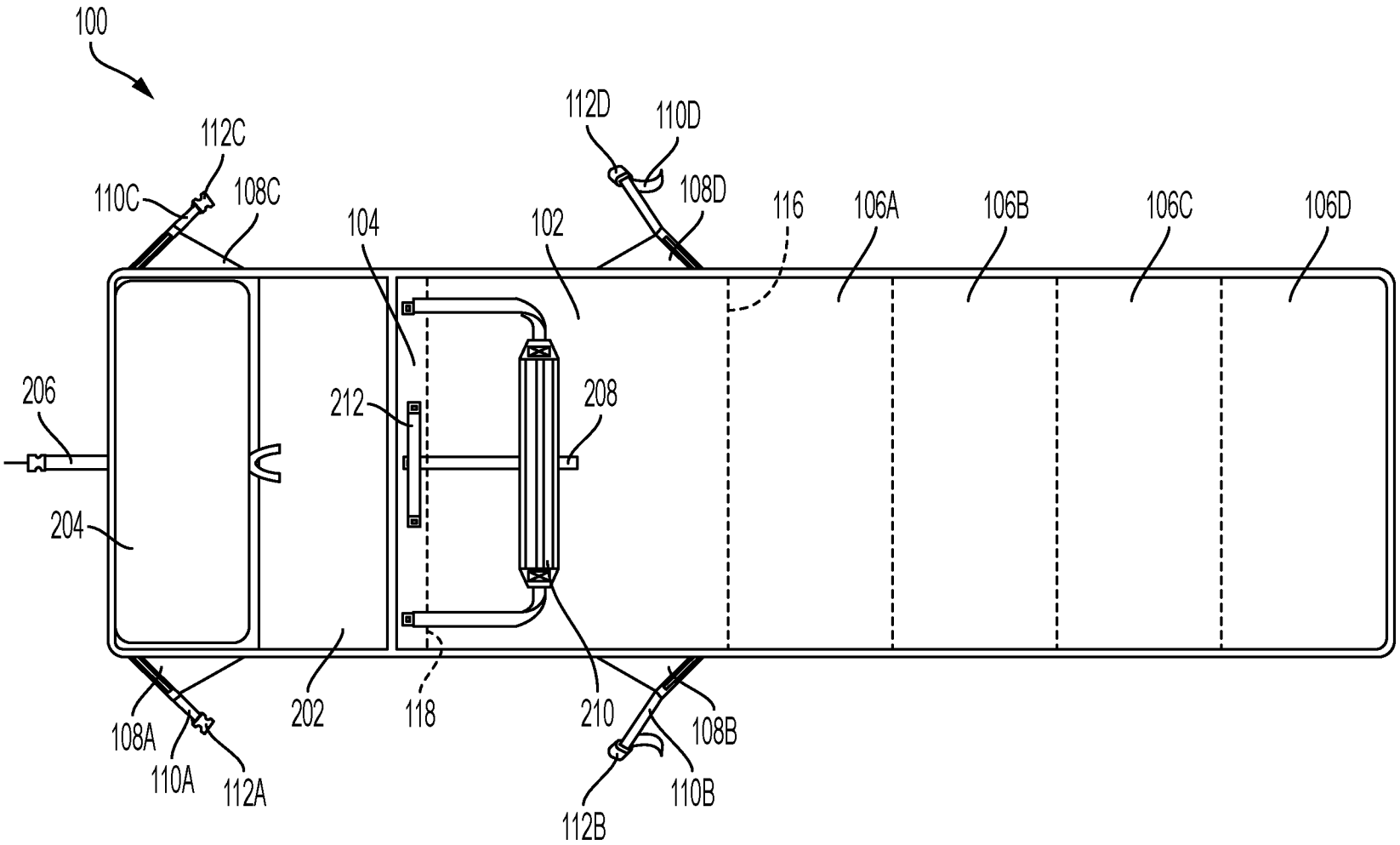
FIG. 2 is a top view of an exemplary flexible internal frame back support with lounge mat in a flattened configuration, consistent with disclosed embodiments.

Referring to FIG. 2, back support 100 may also be configured into a flattened configuration. While the flattened configuration is useful illustrative purposes, it can also provide a unique use case for the user. For example, a user can lay flat on the lounger 100 and be horizontal (as opposed to the more upright position shown in FIG. 1). Lounger 100 can include a female cinch straps 206, 208, which may be wrapped around lounger 100 and connected together with, for example, a buckle to cinch lounger 100 together in a folded configuration (as illustrated in FIGS. 5A-B). Lounger 100 may also include a stretch pocket 202 and a zipper pocket 204 on the outside face of panel 104. Stretch pocket 202 can be a three-sided pocket with an open top. The outer edge of the open top may include elastic or a similar material to pull the top closed against the outer face of support panel 104. Zipper pocket 204 can be a pocket on the outside of support panel 104 that is closeable with a zipper. While the Figures illustrate a single stretch pocket 202 and a zipper pocket 204, other configurations of pockets are possible. For example, in some embodiments, lounger 100 may include two zipper pockets and no stretch pockets, or a single stretch pocket and no zipper pockets. In other embodiments, support panel 104 may not include any pockets. Furthermore, other shapes and sizes of pockets are possible. For example, lounger 100 may include a stretch pocket 202 that covers about two thirds of the outer face of support panel 104 and a smaller zipper pocket 204 that covers about one third of the outer face of support panel 104. Accordingly, the particular configuration of pockets on lounger 100 may vary. However, one advantage of the illustrated configuration of having stretch pocket 202 near and generally parallel to hinge 118 is that a user may insert a blanket, jacket, or other article to form a sort of pillow within stretch pocket 202 on which the user can rest his or her head when using lounger 100 in the flattened mat configuration. Lounger 100 may further include a shoulder strap 210 and a carry handle 212 for convenient transport.

Figure 3:
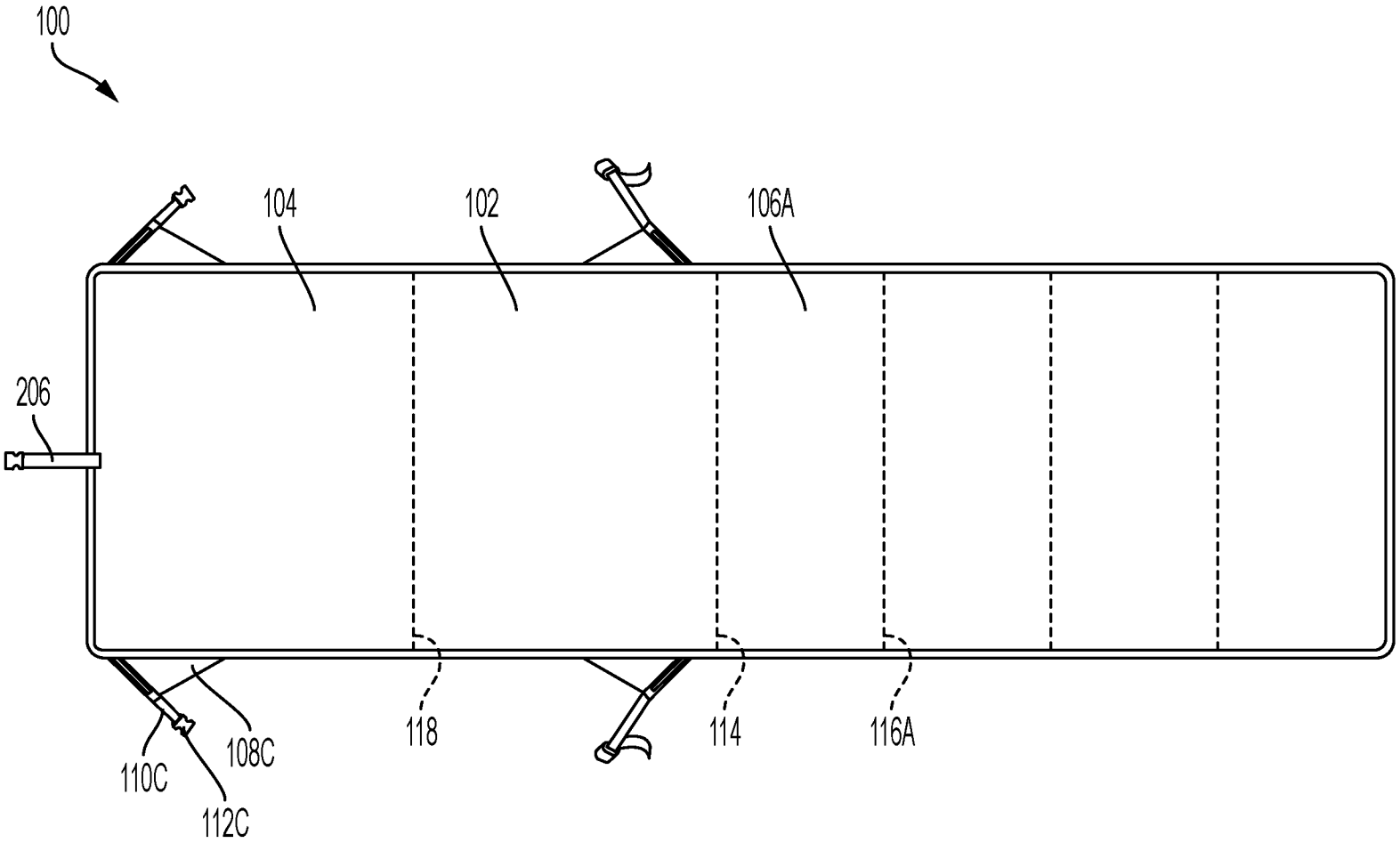
FIG. 3 is a bottom view of an exemplary flexible internal frame back support with lounge mat in a flattened configuration, consistent with disclosed embodiments.
Figure 4:
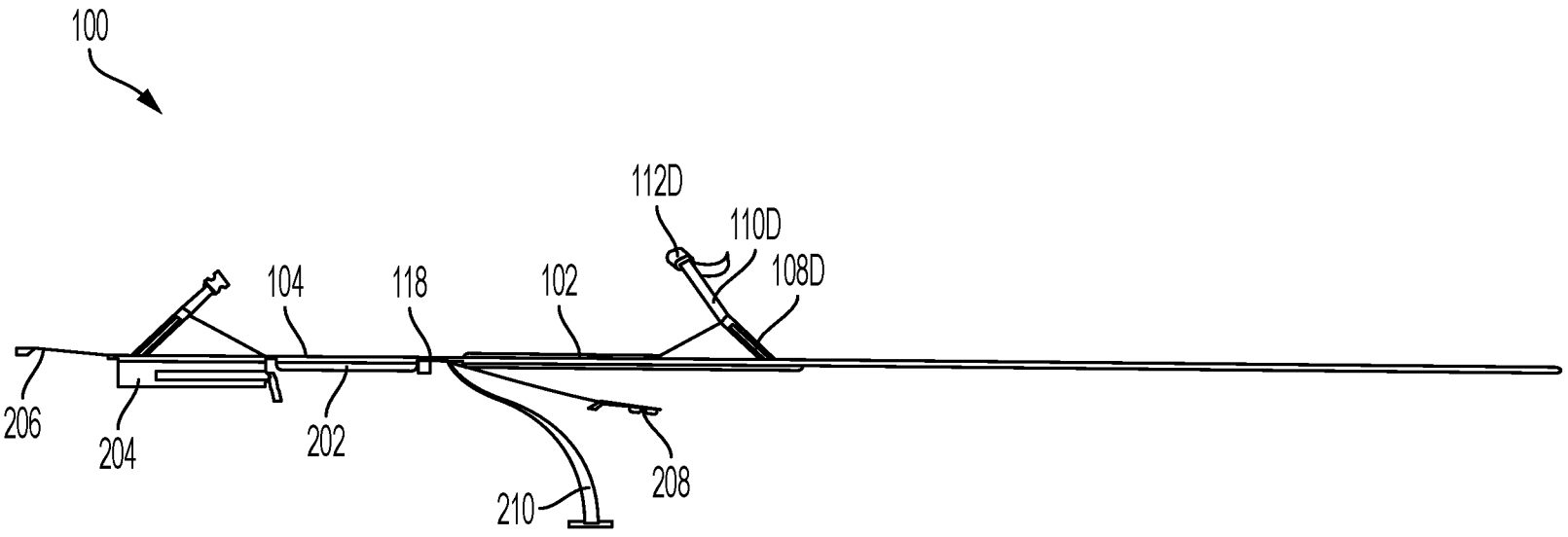
FIG. 4 is a side view of an exemplary flexible internal frame back support with lounge mat in a flattened configuration, consistent with disclosed embodiments.

Referring to FIG. 3, ground mat panel's 106A-D can be folded and placed between inner (bottom side) faces of support panel 104 and backrest panel 102. Such a folded configuration is illustrated by FIG. 5B. The bottom of lounger 100 (illustrated by FIG. 3) can be in contact with the ground (e.g., grass in a park or sand on a beach) when in use. Of course, in some configurations (e.g., when the back rest is in use, as shown in FIG. 1), the inner faces of backrest panel 102 and support panel 104 may not touch the ground. FIG. 4 illustrates a side view of exemplary lounger 100 further illustrating location of gussets 108, stretch pocket 202, zipper pocket 204, cinch straps 206, 208, shoulder strap 201 and carry handle 212.

Figure 6:
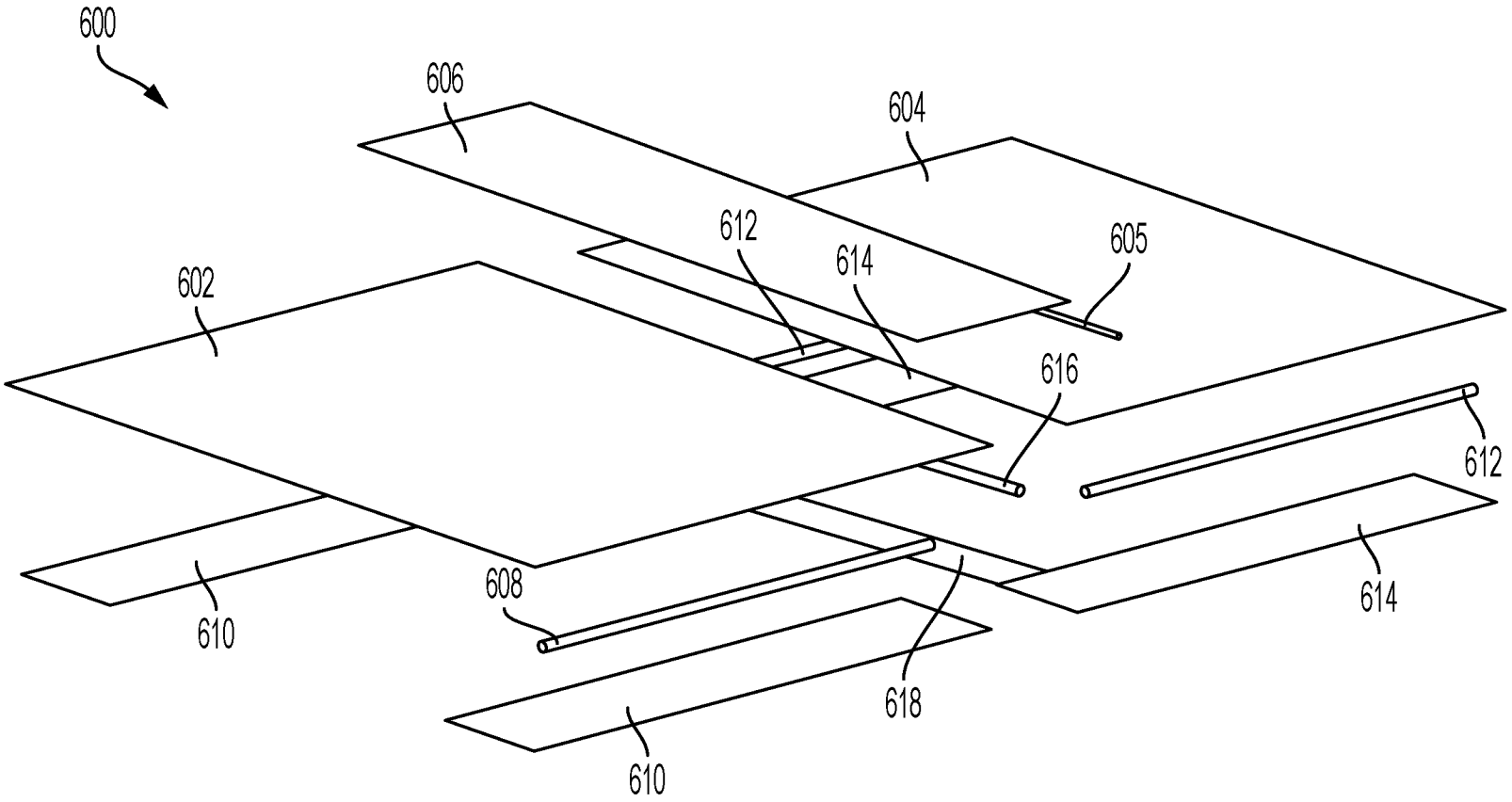
FIG. 6 is an illustration depicting an exemplary internal structure of a flexible internal frame back support with lounge mat, consistent with disclosed embodiments.
Figure 7:
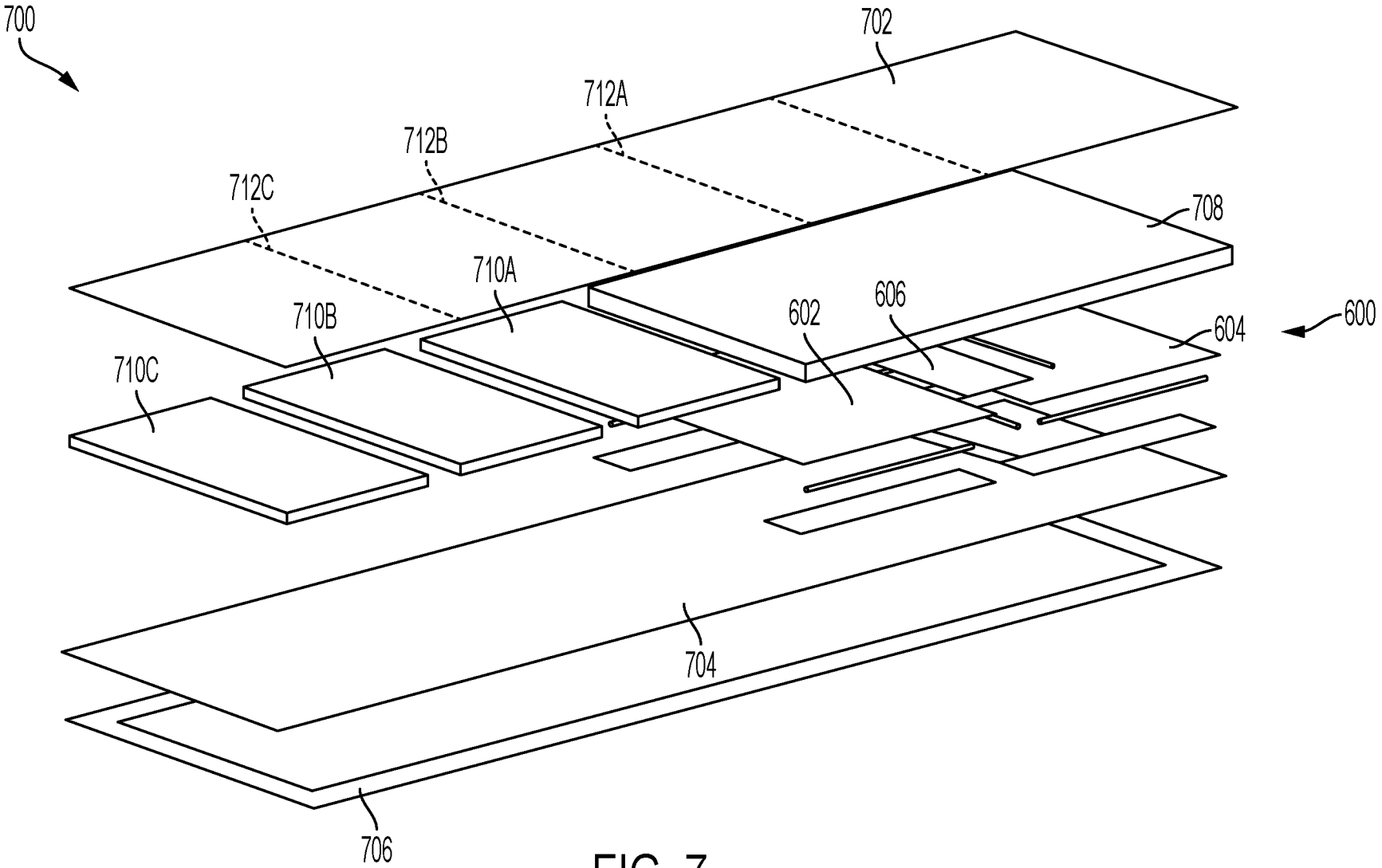
FIG. 7 is an illustration depicting an exemplary internal structure of a flexible internal frame back rest with lounge mat, consistent with disclosed embodiments.
Figure 8:
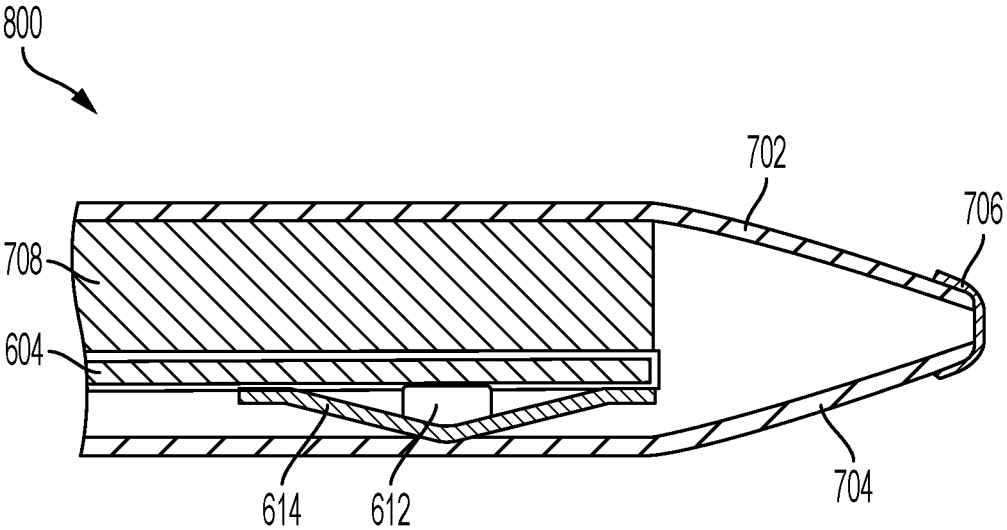
FIG. 8 is a cutaway side view showing an exemplary internal structure of a flexible internal frame back support with lounge mat, consistent with disclosed embodiments.

Referring generally to FIGS. 6-8, exemplary internal structure for back support 100 is disclosed. FIG. 6 is an illustration depicting an exploded view of an exemplary internal structure of a flexible internal frame back rest with lounge mat, consistent with disclosed embodiments. Specifically, FIG. 6 illustrates internal frame structure 600 of backrest panel 102 and support panel 104. Backrest panel 102 can include flexible support sheet 602, vertical internal frame members 608, and internal frame sleeve 610. Support panel 104 can include flexible support sheet 604, vertical internal frame members 612, internal frame sleeve 614, horizontal internal frame member 616, and internal frame sleeve 618. Flexible support sheet 604 may include relief cut 605 to provide additional flexibility to support panel 104 under load. Relief cut 605 may be positioned horizontally along the upper half of flexible support sheet 604 to permit top of flexible support sheet 604 to displace more than the bottom. Such additional relative displacement can help the support sheet conform around a user when a user leans against back support 100.

Flexible support sheets 602, 604 can be configured to provide structure to backrest panel 102 and support panel 104, but flexible enough to deform under the weight of a seated user leaning against backrest panel 102. Flexible support sheets 602, 604 can be made from a variety of materials including but not limited to various plastics such as Polyethylene (PE), ABS, and others.

Flexible support sheets 602, 604 can be connected by hinge 606. In some embodiments, hinge 606 can correspond to hinge 118 of FIGS. 1-4. In some embodiments, hinge 606 can be one or pieces of webbing strap, which can be stitched, glued, taped, attached with one or more fasteners, or otherwise attached to flexible support sheets 602, 604. Certain embodiments may include combinations of two or more attachment methods. In some embodiments, hinge 606 can be an integral hinge formed out of flexible support sheets 602, 604. For example, flexible support sheets 602, 604 could be one contiguous sheet with a hinge portion near the middle. The integral hinge portion could be a groove or otherwise a thinned out portion of the flexible support sheet 602, 604. In yet further embodiments, hinge 606 could be a sewn area of the cover (e.g., as described in greater detail below with respect to FIG. 7 and hinge 712A-C), a flexible piece of foam; a non-integral plastic hinge attached as described above with respect to a webbing hinge or welded, etc. to the flexible support sheets 602, 604.

Internal frame structure 600 can further include vertical and horizontal internal frame members 608, 612, 616 to provide additional structure and stiffening to back support 100. Vertical and horizontal internal frame members 608, 612, 616 can take the form of elongated rods. The vertical and horizontal internal frame members 608, 612, 616 can have a variety of cross-sectional shapes, including circular, square, rectangular or semi-rectangular (as depicted by FIG. 8), or others. In some embodiments, the vertical and horizontal internal frame members 608, 612, 616 may be relatively stiffer than flexible support sheets 602, 604. However, vertical and horizontal internal frame members 608, 612, 616 may still deflect under load of a seated human user leaning against the back support 100. Vertical and horizontal internal frame members 608, 612, 616 can be made of a variety of materials including but not limited to fiberglass, carbon fiber, or other composites. Using such materials can reduce the weight of the lounger 100 while still providing enough structure and stiffness to support the use. In some embodiments, other types of materials may be used such as metals (e.g., aluminum, titanium, etc.), wood, plastics (e.g., ABS, Nylon, etc.), or other suitable materials. Vertical and horizontal internal frame members 608, 612, 616 may include end caps made of a different material (e.g., plastics, rubber, etc.). The end cap can cover the ends of vertical and horizontal internal frame members 608, 612, 616, ensuring the ends are not sharp or abrasive (so as to not cut other nearby components, such as a webbing strap for internal frame sleeves 610, 614, 618 described below).

Internal frame sleeves 610, 614, 618 may attach to flexible support sheets 602, 604 in the locations depicted in FIGS. 6-8. Internal frame sleeves 610, 614, 618 may be individual sleeves closed off except for one or two short ends and configured to receive an internal frame member. Internal frame sleeves 610, 614, 618 may then be attached to flexible support sheets 602, 604. In other embodiments, internal frame sleeves 610, 614, 618 may be a piece of material attached to one of flexible support sheets 602, 604 such that a cavity is formed between the internal frame sleeve 610, 614, 618 and flexible support sheet 602, 604. The cavity can be sized to receive an internal frame member 608, 612, 616. An example of such an embodiment is depicted by FIG. 8. In some embodiments, the ends of internal frame sleeves 610, 614, 618 can be closed to completely secure internal frame members 608, 612, 616 to flexible support sheets 602, 604. Internal frame sleeves 610, 614, 618 can be constructed from various materials such as webbing straps or other fabrics or fibers, plastics, or others. Internal frame sleeves 610, 614, 618 can be attached to flexible support sheets 602, 604 in a variety of suitable ways, such as stitching, glue, tape, fasteners, plastic welding, or other suitable methods. While the Figures depict internal frame sleeves 610, 614, 618 as a solid sleeve spanning the length of internal frame members (with some overlap on each side for closing the ends), other configurations are possible. For example, internal frame sleeves 610, 614, 618 can be two pockets, with a pocket securing each end of an internal frame member. As another example, internal frame sleeves 610, 614, 618 can be two end pockets with a small webbing loop in the middle through which the internal frame member can pass for additional security.

Figure 9B:
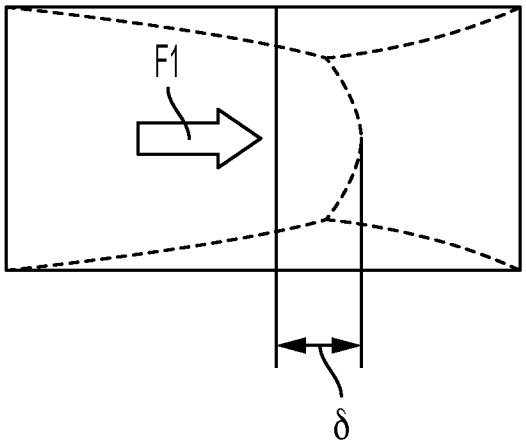
FIG. 9B is an illustration of deformation of an exemplary flexible internal frame back support under the load of a user, consistent with disclosed embodiments.
Figure 9A:
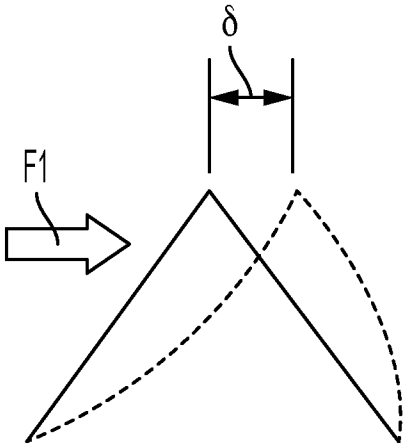
FIG. 9A is an illustration of deformation of an exemplary flexible internal frame back support under the load of a user, consistent with disclosed embodiments.

The vertical frame members 608, 612 can provide stiffness to the backrest panel and support panel 104 in a vertical direction (i.e., in the direction of the length of the vertical frame members). This stiffness can prevent the A-frame of the back support 100 from collapsing down under the weight of the user, but still permit flexibility in a horizontal direction (e.g., parallel to the main axis of hinge 118). Flexible support sheets 602 in backrest panel 102 can provide additional stiffness in the vertical and horizontal directions, but still permits the backrest panel 102 to deform under the weight applied to the backrest panel 102 by a user and conform around the user's shoulders when using back support 100. Horizontal and vertical internal frame members 608, 612, 618 can be relatively stiffer than the flexible support sheets 602, 604 and hinge 118. Thus, horizontal and vertical internal frame members 608, 612, 618 may deform less than flexible support sheets 602, 604 and hinge 118. A horizontal frame member 618 can provide some stiffness in a horizontal direction to the support panel 104, but still permits the support panel 104, backrest panel 102, and hinge 118 to deform and curve around a user's shoulders. Examples of such deformation are illustrated by FIGS. 9A and 9B. Specifically, in a loaded configuration when a user is leaning against back support 100, backrest panel 102 and hinge 118 can form a curved surface (i.e., concave) in which the user's shoulders can sit. The top edge of backrest panel 102 (i.e., the edge adjacent to hinge 118) may deform more than the bottom edge of backrest panel 102 (adjacent to hinge 114). The deformation and curvature of loaded back support 100 can support the user and prevent a user from having a rigid bar uncomfortably resting against his or her back, but the stiffness of the internal frame structure 600 can provide enough stiffness to support the user's back in an at least semi-upright position.

This construction provides significant advantages over a stiff external frame design. For example, the flexibility provided by the flexible support sheets and internal frame members can cause the back support 100, specifically backrest panel 102 to bend and conform around the body of a user. Such a flexible conforming shape can greatly increase the comfort of the back support compared to conventional approaches. Additionally, using thin flexible sheets and relatively small flexible internal frame components provides a lightweight and streamlined back support 100 that is easy to transport and not bulky.

FIG. 7 is an illustration depicting an exploded view of exemplary construction 700 of a flexible internal frame backrest with lounge mat, consistent with disclosed embodiments. Exploded structure 700 depicts internal frame structure 600 of backrest panel 102 and support panel 104 (as shown in FIG. 6), as well as exemplary internal structure for other components of back support 100. Back support 100 can include a top cover 702 and a bottom cover 704. As illustrated by FIG. 8, top cover 702 and bottom cover 704 can be attached together (e.g., through stitching, glue, tape, etc.) using edge binding 706 (such as a polyester edge binding tape) to form a cohesive cover for back support 100. Top cover 702 and bottom cover 704 can be made from a variety of materials. In some embodiments, because the back support can be used outdoors, for example, in a grassy park or on a beach, a durable water-repellant material, such as a water-resistant polyester fabric or similar material, may be desirable. Other fabrics, plastics, etc., however, can be used.

Other components can be placed between top cover 702 and bottom cover 704. For example, internal frame structure 600, including flexible support sheets 602, 604, hinge 606, and internal frame members and sleeves, can be placed in the space between top cover 702 and bottom cover 704. Additionally, foam cushioning can be placed between top cover 702 and bottom cover 704 to cushion the user's body and provide a comfortable lounging experience to the user. Backrest foam 708 can be placed on the top side of internal frame structure 600 to provide cushioning for the user when the user is seated and resting against the backrest panel 102. While depicted as a single piece, in some embodiments, backrest foam 708 may be multiple pieces. In some embodiments, backrest foam 708 can be glued, taped, sewn, fastened, or otherwise attached to one or more components of internal frame structure 600.

Ground mat panel foam 710A-C can be placed between the lower ground mat portions of top cover 702 and bottom cover 704 to form ground mat panels 106A-D. While FIG. 7 depicts three ground mat panels, as described herein, more or fewer panels may be used. For example, FIGS. 1-4 depict a back support 100 with four ground mat panels. Individual ground mat panels may be separated by ground mat panel separations 712A-C, which may, for example, take the form of stitching that connects top cover 702 to bottom cover 704 in the areas between pieces of ground mat panel foam 710A-C. The combination of the stitching, top cover 702, and bottom cover 704 can form hinges 116A-C. 712A as depicted may represent hinge 114, between backrest panel 102 (and backrest foam 708) and the first ground mat panel 106A (and ground mat panel foam 710A). As another example, separation 712C can form a hinge 116B between ground mat panel foam 710B and ground mat panel foam 710C.

In some embodiments, as depicted in FIG. 7, backrest foam 708 can be thicker than ground panel foam 710. In other embodiments, backrest foam 708 may be the same thickness or thinner than one or more pieces of ground panel foam 710. Backrest foam 708 can be various thicknesses, for example, about 0.5 inches, or a range from about 0.25 inches to about 0.75 inches. Similarly, ground mat foam 710 can be various thicknesses, for example, about 0.3 inches, or a range from about 0.1 inches to about 0.75 inches. Both backrest foam 708 and ground mat foam 710 can be made from any suitable cushioning foam material, such as polyethylene foam or other.

FIG. 8 is a cutaway side view 800 showing an exemplary internal structure of a flexible internal frame backrest with lounge mat, consistent with disclosed embodiments. FIG. 8 illustrates the construction of a support panel 104, but one having ordinary skill in the art would understand that a backrest panel 102 could have the same or substantially similar construction. As described above with respect to FIGS. 6 and 7, support panel 104 can include top cover 702 and bottom cover 704 connected with edge binding 706. However, in some embodiments, edge binding 706 may not be present. For example, top cover 702 could be attached directly to bottom cover 704. Between top cover 702 and bottom cover 704 can be backrest foam 708 and flexible support sheet 604. In some embodiments, backrest foam 708 can be attached to flexible support sheet 604 with, for example, glue, tape, stitching, fasteners, etc. As described above, internal frame member 612 can be attached to flexible support sheet 604 with internal frame sleeve 614.

FIG. 9A is an illustration of deformation of an exemplary flexible internal frame back rest under the load of a user, consistent with disclosed embodiments. As with the other Figures, FIGS. 9A and 9B are not to scale. Accordingly, actual deformation may vary within the spirit of this disclosure. FIG. 9A is illustrates a side view of back support 100 when loaded by user force F1 (illustrated by the arrow). The A-frame of back support 100 (in solid lines) can deform and curve into the form shown by the broken lines. The peak (i.e., the hinge point) can displace horizontally by a distance δ. Although not depicted in FIG. 9A, in some embodiments, the hinge point may also displace in the vertical direction, in addition to the horizontal direction. For example, the peak may move down and to the right.

FIG. 9B is an illustration of deformation of an exemplary flexible internal frame back rest under the load of a user, consistent with disclosed embodiments. FIG. 9B illustrates a top view of back support 100 when loaded by force F1. The A-frame of back support 100 (in solid lines) can deform and curve into the form shown by the broken lines. The peak (i.e., the hinge point) can displace horizontally by the distance δ. Distance δ can vary based on, for example, the specific materials from which back support 100 is constructed and the force placed on back support 100 by the user. In some embodiments, the distance δ may be at least 1 inch. In other embodiments, the distance δ may range from 0.5 inches to 4 inches. The hinge may also form a curved surface as shown in FIG. 9B, which can conform around the user's shoulders. In some embodiments the left and right edges of backrest panel 102 and support panel 104 may also bend and deform inwards, as illustrated (in broken lines) by FIG. 9B.

The foregoing merely illustrates the principles of the disclosure. Any examples set forth in this specification are not intended to be limiting and merely set forth some of the many possible embodiments for the appended claims. Those skilled in the art will readily recognize various modifications and changes that may be made without following the example embodiments and applications illustrated and described herein, and without departing from the true spirit and scope of the following claims.

All references cited and/or discussed in this specification are incorporated herein by reference in their entireties and to the same extent as if each reference was individually incorporated by reference.

What is claimed is:

1. A back support comprising:

a backrest panel comprising:
- a first internal frame member,
- a first flexible support sheet, and
- a first cover;

a support panel comprising:
- a second internal frame member,
- a second cover, and
- a pocket extending along an edge of the support panel;

a first hinge separating the backrest panel from the support panel, each of the backrest panel and the support panel having a first length in a direction orthogonal to the first hinge;

a first ground mat panel and a second ground mat panel, each of the first ground mat panel and the second ground mat panel having a second length in the direction, the second length being less than the first length;

a second hinge separating the first ground mat panel from the backrest panel; and a third hinge separating the second ground mat panel from the first ground mat panel;

wherein the backrest panel and support panel are hingedly connected along an edge of the backrest panel and the edge of the support panel by the first hinge; and wherein in each of a first position configured to support a user and a second position being a collapsed position for transportation, the pocket is positioned on a side of the support panel opposite the backrest panel.

2. The back support of claim 1, wherein the support panel further comprises a second flexible support sheet.

3. The back support of claim 2, wherein the first flexible support sheet and the second flexible support sheet are hingedly connected to form a hinge connection between the backrest panel and the support panel.

4. The back support of claim 3, wherein the hinge connection between the first flexible support sheet and the second flexible support sheet comprises webbing attached to both the first flexible support sheet and the second flexible support sheet.

5. The back support of claim 1, wherein the back support is configured to have a third position, the third position being an extended flattened position.

6. The back support of claim 1, wherein the backrest panel is configured to deform under a weight of a user applied to the back support when in the first position.

7. The back support of claim 6, wherein the backrest panel is configured to form a curved surface along a hinge connection at the edge of the backrest panel and the edge of the support panel.

8. The back support of claim 1, wherein the first and second internal frame members are configured to provide stiffness to the back support in a vertical direction and permit deformation in a horizontal direction.

9. The back support of claim 1, wherein:

the backrest panel further comprises a third internal frame member; and the support panel further comprises a fourth internal frame member.

10. The back support of claim 1, wherein the backrest panel further comprises a cushion sheet.

11. The back support of claim 1, wherein the support panel further comprises a horizontal internal frame member.

12. The back support of claim 1, wherein the first flexible support sheet comprises a polyethylene sheet.

13. A back support comprising:

a backrest panel having a top edge and a bottom edge;

a support panel having a top edge and a bottom edge;

a hinge connected to the top edge of the backrest panel and the top edge of the support panel, each of the backrest panel and the support panel having a first length extending in a direction orthogonal to the hinge;

a first ground mat panel extending from the backrest panel and a second ground mat panel extending from the first ground mat panel, each of the first ground mat panel and the second ground mat panel having a second length in the direction;

a first cinch strap coupled to the backrest panel;

a second cinch strap coupled to the support panel and configured to be coupled to the first cinch strap in a folded position, wherein each of the first cinch strap and the second cinch strap are configured to be wrapped around a portion of each of the backrest panel and the support panel in the folded position retaining each of the first ground mat panel and the second ground mat panel between the backrest panel and the support panel; and a first gusset and a second gusset coupled to lateral edges of each of the backrest panel and the support panel and configured to facilitate coupling of the backrest panel and the support panel in a first position;

wherein the hinge, the top edge of the backrest panel, and the top edge of the support panel are configured to deform under a load applied by a user resting against the back support in the first position.

14. The back support of claim 13, wherein the hinge and the backrest panel are configured to conform around shoulders of the user.

15. The back support of claim 13, wherein the deformation of the top edge of the backrest panel is greater than the deformation of the bottom edge of the backrest panel.

16. The back support of claim 13, wherein a center point of the top edge of the backrest panel is displaced a distance in a range between 0.5 inches and four inches when the back support is in a loaded in-use position as compared to an unloaded position.

17. The back support of claim 13, wherein:

the backrest panel further comprises first and second internal support members;

the support panel further comprises third and fourth internal support members; and the first, second, third, and fourth internal support members are configured to bend under the load.

18. The back support of claim 17, wherein:

the first, second, third, and fourth internal support members are stiffer than the hinge and deform less than the hinge when the load is applied to the back support.

19. A back support comprising:

a ground mat panel;

a backrest panel extending from the ground mat panel, the backrest panel comprising a first flexible support sheet; and a support panel hingedly coupled to a first portion of the backrest panel and configured to be attached to a second portion of the backrest panel, the backrest panel comprising a second flexible support sheet, the support panel hingedly coupled to the first portion such that when the backrest panel is attached to the second portion, deformation of the first flexible support sheet towards the support panel causes deformation of the second flexible support sheet away from the backrest panel, wherein the deformation of the first flexible support sheet is concave and the deformation of the second flexible support sheet is convex, and wherein deformation of each of the first flexible support sheet and the second flexible support sheet is greater near the first portion.

20. The back support of claim 19, wherein the first flexible support sheet and the second flexible support sheet are made from a plastic.

* * * * *